US005527427A

United States Patent [19]

Berksoy et al.

[11] Patent Number: 5,527,427

[45] Date of Patent: Jun. 18, 1996

[54] HIGH SOLIDS BLACK LIQUOR OF REDUCED VISCOSITY AND VISCOSITY REDUCTION METHOD FOR HIGH SOLIDS BLACK LIQUOR

[75] Inventors: Mualla Berksoy; Yaman Boluk, both of Montreal, Canada

[73] Assignee: Optima Specialty Chemicals & Technology Inc., Montreal, Canada

[21] Appl. No.: 407,619

[22] Filed: Mar. 21, 1995

[51] Int. Cl.[6] ..... D21C 11/00; D21C 11/10

[52] U.S. Cl. ..... 162/30.11; 162/29; 162/45; 162/77; 159/DIG. 17; 423/DIG. 3

[58] Field of Search ..... 162/29, 30.11, 162/30.1, 17, 42, 45, 77; 106/123.1, 271; 44/280, 281; 203/64; 159/DIG. 17, 47.1; 423/DIG. 3

[56] References Cited

U.S. PATENT DOCUMENTS

| | | | |
|---|---|---|---|
| 4,734,103 | 3/1988 | Fong et al. | 44/280 |
| 4,776,889 | 10/1988 | Diep et al. | 106/123.1 |
| 4,787,915 | 11/1988 | Meyer et al. | 44/51 |
| 5,201,172 | 4/1993 | Hakulin et al. | 60/39.05 |

FOREIGN PATENT DOCUMENTS

| | | | |
|---|---|---|---|
| 2237751 | 5/1991 | United Kingdom | B01D 1/00 |

*Primary Examiner*—David L. Lacey
*Assistant Examiner*—Jose A. Fortuna
*Attorney, Agent, or Firm*—Dvorak and Traub

[57] ABSTRACT

A high solids black liquor which has solids content of at least 65% by weight of liquor is mixed with a viscosity reducing additive prior to firing in a chemical recovery furnace. The additive is an admixed compound consisting of monoethylene glycol, diethylene glycol and triethylene glycol.

10 Claims, 2 Drawing Sheets

HIGH SOLIDS BLACK LIQUOR OF REDUCED VISCOSITY AND VISCOSITY REDUCTION METHOD FOR HIGH SOLIDS BLACK LIQUOR

BACKGROUND OF THE INVENTION

The sulfate or kraft process is the dominant alkaline pulping technique used in the pulp and paper industry. The spent liquor resulting from the pulping process is commonly known as black liquor. It contains various organic materials as well as the inorganic pulping chemicals in an aqueous medium. The typical contents of black liquor are: dissolved wood substances (polymeric lignin and various aromatic organic compounds); carbohydrate derivatives (cellulose and hemicellulose degradation products); extracted light organic compounds (fatty and resinous acids); and inorganic chemicals from cooking liquor (sodium hydroxide, sodium sulphide, sodium carbonate, sodium sulphite and sodium chloride). The black liquor is concentrated by evaporation and fired in a boiler.

It is well established that the regeneration of the black liquor to fresh white liquor is an economically and environmentally necessary part of the kraft process. The recovery of the pulping chemicals is obtained by incinerating the black liquor in a chemical recovery boiler. The chemical recovery boiler is perhaps the single most important unit in a kraft process. In the boiler, the organic matter in the black liquor is combusted hence generating process heat in the form of steam. Meanwhile, an inorganic smelt is also produced, recovered from the boiler and dissolved to yield what is known as green liquor. The green liquor is then treated by causticizing it with slaked lime. The resultant solution of fresh pulping chemicals also known as white liquor can be used again in the digester unit. Maximum recovery of heat and pulping chemicals and the minimum generation of polluting wastes are crucial to the overall pulping process.

It is well established that energy saving, enhancement of the chemical recovery boiler throughput capacity, and abatement of pollution, notably $SO_2$ and $H_2S$ flue gas emissions, are improved by incinerating a more concentrated black liquor in the recovery boiler. Such concentrated black liquors are known as high solids content black liquor. Their concentration is usually expressed as a weight percentage of solids content. To illustrate the importance of higher solids concentration in black liquor, it has been shown that if the solids content were raised from 60% to 80% before firing, the energy saving would be about $760\times10^9$ J/day for a typical 1000 ton/day mill. Consequently, there is a continuous trend toward firing black liquor at higher solids concentrations in the recovery boiler.

However, the single most important drawback to firing high solids content black liquor relates to its viscosity which dramatically increases with its solids content. The more the black liquor is concentrated in evaporators and the like, the more it tends to cause plugging of the evaporators, concentrators, transport lines, and the boiler firing nozzles. Consequently, although it is possible to currently obtain solids content of about 85%, black liquor solids content is generally maintained at approximately 60–65% to avoid plugging and fouling of equipment.

Various attempts have been made to modify the evaporators, transport lines and nozzles to permit the handling of higher solids content black liquor. However, these attempts have gained little acceptance in view of the substantial capital investments and technical difficulties.

To avoid large capital expenses and equipment modifications, viscosity reducing additives to the black liquor have been proposed. Notably, U.S. Pat. No. 4,776,889 teaches the addition of waxes as viscosity reducing agents and U.S. Pat. No. 4,734,103 teaches the addition of a water soluble terpolymer composition. Japanese Patent 59228094 teaches the addition of high molecular weight poly-ether diols made from mixtures of polypropylene glycol and polyether oxide or propylene oxide. However, these techniques have also met with limited market acceptance.

Consequently, there remains an important need for the discovery of improved viscosity reducing additives.

It is therefore an object of the present invention to provide a black liquor comprising a viscosity reducing additive which will allow the firing of black liquors having solids content higher than 65% wt.

It is another object of the present invention to provide a viscosity reducing additive which will improve the overall economic feasibility, tend to diminish the obnoxious wastes, and tend to improve the firing characteristics of the chemical recovery boiler operation.

Other objects and further scope of applicability of the present invention will become apparent from the detailed description given hereinafter.

It should be understood, however, that this detailed description, while indicating preferred embodiments of the invention, is given by way of illustration only, since various changes and modifications within the spirit and scope of the invention will become apparent to those skilled in the art.

SUMMARY OF THE INVENTION

The invention provides a high solids content black liquor having the property of reduced viscosity comprising:

a high solids black liquor which has a solids content of at least 65% by weight of liquor and a viscosity reducing additive comprising a compound selected from monoethylene glycol, diethylene glycol, triethylene glycol and mixtures thereof.

One embodiment of the invention provides a method for reducing the viscosity of high solids content black liquor comprising treating the black liquor with about 0.01 to 10% by weight, and preferably 0.2 to 1% by weight, of a viscosity reducing additive selected from the compounds comprising monoethylene glycol, diethylene glycol, triethylene glycol and mixtures thereof.

Thus, the additive formulation of the present invention controls and reduces the viscosity of the high solids content black liquor, thus improving processing, handling and firing performances of black liquor during the recovery process.

Other features and advantages of the invention will become apparent to those of ordinary skill in the art upon review of the following detailed description, claims, and drawings.

DETAILED DESCRIPTION OF THE INVENTION

As stated in the summary of the invention, the invention comprises providing a modified black liquor having solids content of at least 50% and a viscosity reducing additive selected from monoethylene glycol, diethyelene glycol, triethylene glycol or mixtures thereof. These compounds are of course well known as anti freeze-coolants, brake fluids, paint solvents, plasticizers, and so on. However, their use as viscosity reducing additives for alkaline pulping black liquors is clearly novel.

The chemical representations for mono-, di- and triethylene glycol are as follows:

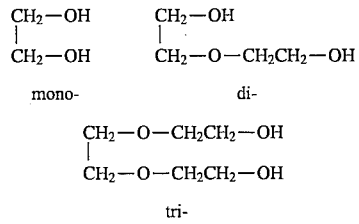

When synthesized, mono-, di-, and tri- ethylene glycols are usually separated in distillation towers to yield separate mono-, di- and tri-ethylene fractions. Due to their higher molecular weights, di- and tri-ethylene fractions are found in the distillation bottoms. In accordance with a preferred embodiment of the present invention, it will be preferable to use the blend of ethylene glycol fractions which is least expensive on the open market. This will tend to maximize the economic efficiency of the chemical recovery boiler used to burn the modified black liquor. Also in accordance with a preferred embodiment of the invention, the amount of ethylene glycol additive is about 0.2 to 0.5% by weight of the resulting black liquor. However, concentrations ranging from about 0.01 to 10% are acceptable. In any event, the exact proportion of ethylene glycol additive is not crucial to the present invention. It is surmised that the proper proportions will depend on the exact composition of the black liquor to be treated and the economic feasibility of the overall chemical recovery process. Optimum proportions of ethylene glycol additives can therefore be easily determined by those skilled in the art.

Figure 1:
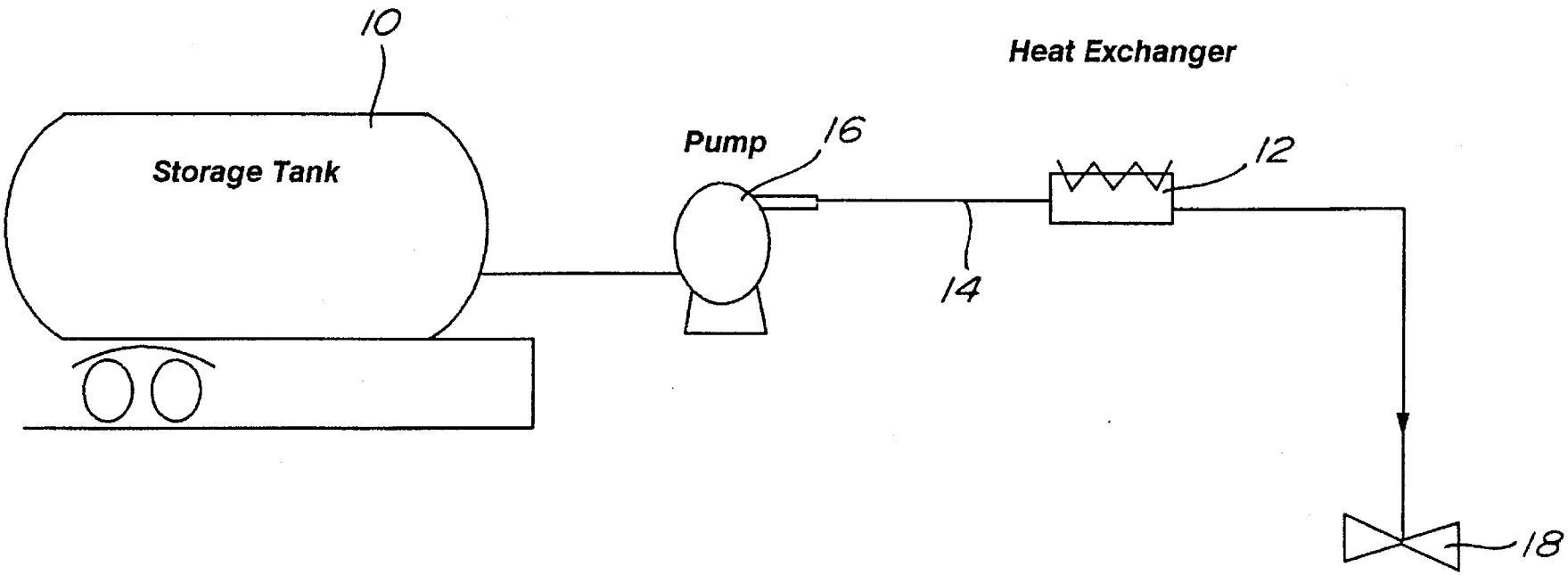
FIG. 1 is a schematic representation of a preferred embodiment of a system suitable for carrying out the present invention.

Referring now to FIG. 1, there will be described a preferred embodiment of the present invention. A mobile storage tank 10 contains a black liquor additive comprising mono-, di- or tri-ethylene glycols or blends thereof. The additive composition is pumped to a heat exchanger 12 via transport line 14 and pump 16. Heat exchanger 12 heats the additive composition to approximately 175° to 300° F. The warm additive composition is then piped to a valve 18 which introduces the additive to the black liquor.

Figure 2:
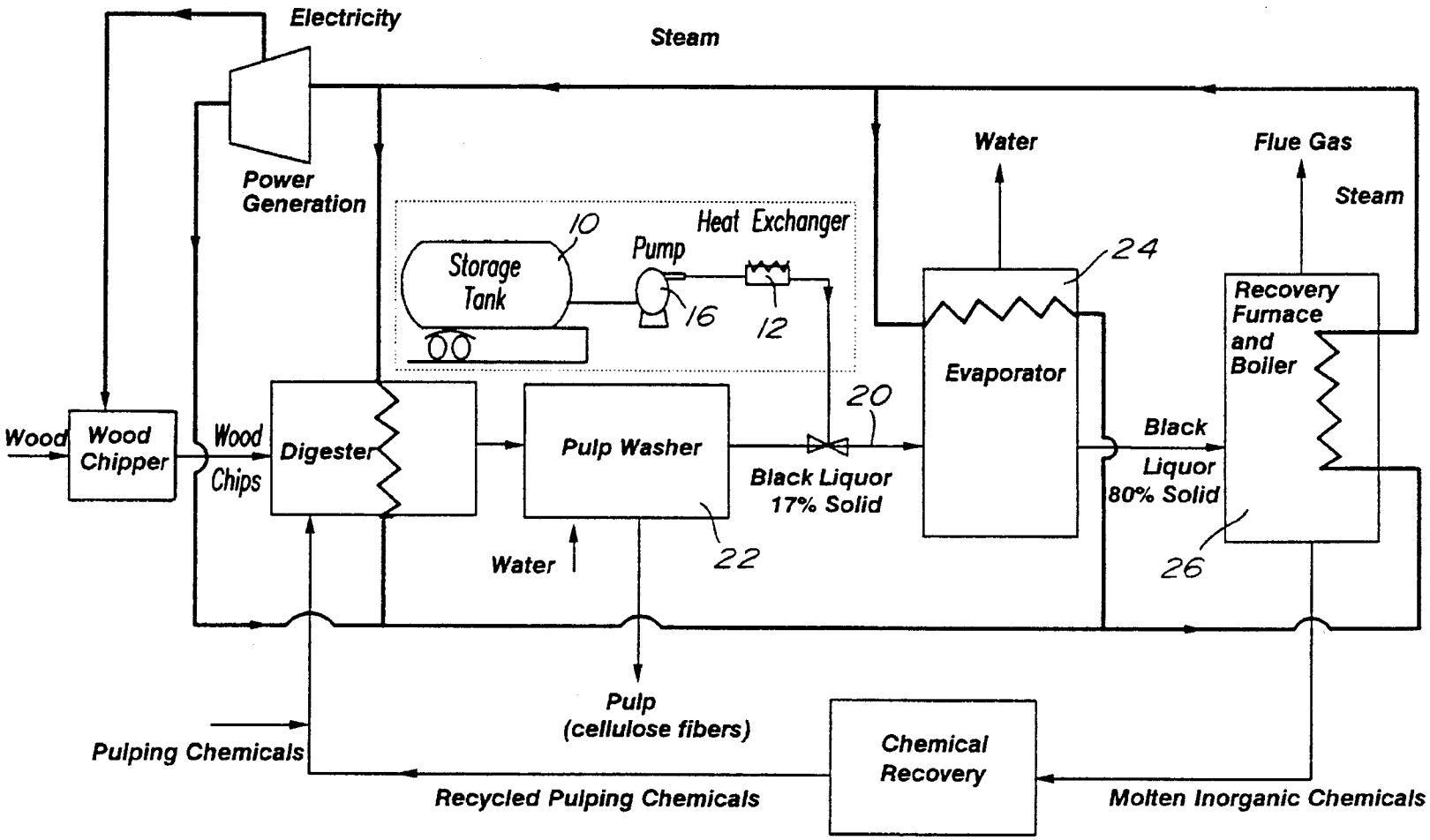
FIG. 2 is a schematic representation of a conventional kraft pulping chemical recovery system which is shown incorporating the preferred embodiment of the present invention shown in FIG. 1.

FIG. 2 schematically illustrates where the introduction of the warm additive could take place. In this case, the introduction of the additive is made in to the black liquor line 20 downstream of the pulp washer unit 22. The modified black liquor then goes through a multistage evaporator/concentrator unit 24 to yield a high solids content black liquor. In a most preferred embodiment, the concentrated black liquor will have a solids content of about 80% wt. The concentrated black liquor is then fired in the recovery boiler 26 through a suitable nozzle (not shown). It is to be understood that the introduction of the viscosity controlling and reducing additive can take place anywhere in the black liquor line between the pulp washer unit 22 and the recovery boiler 26. However, it appears preferable to add the mono-, di-, and tri- ethylene glycols early on, i.e. in unit 24, after the multiple effect evaporators but before the concentrator, since the black liquor viscosity reduction increases the process capacity by providing good heat transfer in concentrators, good pumping in the transfer lines and good nozzle spraying in the chemical recovery boiler.

As stated before, the addition of mono-, di-, and triethylene glycols sufficiently controls the viscosity of the black liquor to render it easy to handle, even with solids content greater than 65% wt, without plugging and fouling of fluid transport equipment, evaporators and the like and firing nozzles. Moreover, it is apparent that the implementation of the present invention does not require large capital investments and will favorably improve the overall economy, capacity and pollution control of the chemical recovery process.

EXPERIMENTAL

For illustrative purposes only, the invention will now be described in conjunction with the following

Example 1.

Viscosity measurements were performed on a 62% wt solids content black liquor separately treated with three different viscosity lowering agents. Viscosity was measured at 80° C. using a Brookfield type viscometer. As in well known to those skilled in the art, the viscometer measures viscosity by measuring the force required to rotate a spindle in the fluid to be tested. For reference purposes, the viscosity of the untreated black liquor was also measured under the same conditions. The results are compiled in Table 1, below. The three illustrative viscosity lowering agents were as follows:

1. Viscosity lowering agent A Monoethylene glycol
2. Viscosity lowering agent B Diethylene glycol
3. Viscosity lowering agent C Mixture of monoethylene glycol (5% wt), diethylene glycol (70%) and triethylene glycol (25% wt). This mixture is typical of by-product of ethylene glycols production by distillation.

TABLE 1

| Concentration of Agent, % wt | 0 | 0.2 | 0.5 |
|---|---|---|---|
| | (Brookfield Viscosity in Cps) | | |
| Agent A | 1150 | 1000 | 900 |
| Agent B | 1150 | 800 | 600 |
| Agent C | 1150 | 700 | 500 |

Although the invention has been described above with respect with one specific form, it will be evident to a person skilled in the art that it may be modified and refined in various ways. It is therefore wished to have it understood that the Present invention should not be limited in scope, except by the terms of the following claims.

The embodiments of the invention in which an exclusive property or privilege is claimed are defined as follows:

1. A high solids content black liquor having the property of a reduced viscosity relative to an initial Brookfield viscosity rating of 1150 CPs comprising: a solids content of at least 50% by weight of liquor and a viscosity reducing additive comprising an admixed compound of monoethylene glycol, diethylene glycol, and triethylene glycol.

2. The high solids content black liquor of claim 1, wherein said viscosity reducing additive is present in a proportion of about 0.01 to 10% by weight of liquor.

3. The high solids content black liquor of claim 1, wherein said viscosity reducing additive is present in a proportion of about 0.2 to 1% by weight of liquor.

4. The high solids content black liquor of claim 1, wherein said viscosity reducing additive is present in a proportion of about 0.5% by weight of liquor.

5. The high solids content black liquor of claim 2 wherein said viscosity reducing additive is added to said high solid content black liquor, in amount between 0.2–05% by weight of liquor such that said reduced viscosity is between 500–700 Cps.

6. The high solids content black liquor of claim 3, wherein said viscosity reducing additive comprises about 70% by weight of additive of diethylene glycol, 25% by weight of additive of triethylene glycol and 5% by weight of additive of monoethylene glycol.

7. The high solids content black liquor of claim 4, wherein said viscosity reducing additive comprises about 70% by weight of additive of diethylene glycol, 25% by weight of additive of triethylene glycol and 5% by weight of additive of monoethylene glycol.

8. A method for reducing the viscosity of a high solids content black liquor comprising the step of treating the black liquor with a viscosity reducing additive comprising an admixed compound of monoethylene glycol, diethylene glycol, and triethylene glycol by mixing about 0.01 to 10% by weight of said additive with said black liquor.

9. The method of claim 8 wherein said black liquor is treated with about 0.2 to 1% by weight of said viscosity reducing additive.

10. The method of claim 8 wherein said black liquor is treated with about 0.5% by weight of said viscosity reducing additive.

* * * * *